US009134655B2

(12) United States Patent
Berg et al.

(10) Patent No.: US 9,134,655 B2
(45) Date of Patent: Sep. 15, 2015

(54) DIGITAL PRINTER WITH SUPPLY ARRANGEMENT TO SUPPLY PRINT GROUPS WITH FLUIDS AND TO ACCEPT USED AND UNCONSUMED FLUIDS

(71) Applicants: Martin Berg, Poing (DE); Otto Ferber, Germering (DE); Franz Kastner, Munich (DE); Attila Bogdan, Rattenkirchen (DE)

(72) Inventors: Martin Berg, Poing (DE); Otto Ferber, Germering (DE); Franz Kastner, Munich (DE); Attila Bogdan, Rattenkirchen (DE)

(73) Assignee: Océ Printing Systems GmbH & CO. KG, Poing (DE)

( * ) Notice: Subject to any disclaimer, the term of this patent is extended or adjusted under 35 U.S.C. 154(b) by 102 days.

(21) Appl. No.: 14/064,568

(22) Filed: Oct. 28, 2013

(65) Prior Publication Data

US 2014/0140730 A1 May 22, 2014

(30) Foreign Application Priority Data

Nov. 16, 2012 (DE) ..... 10 2012 111 041

(51) Int. Cl.
*G03G 15/10* (2006.01)
*G03G 15/11* (2006.01)

(52) U.S. Cl.
CPC ..... *G03G 15/11* (2013.01); *G03G 15/104* (2013.01); *G03G 2215/00021* (2013.01)

(58) Field of Classification Search
CPC ..... G03G 15/10; G03G 15/11; G03G 15/104; G03G 2215/00021
USPC ..... 399/238, 233
See application file for complete search history.

(56) References Cited

U.S. PATENT DOCUMENTS

| | | | |
|---|---|---|---|
| 5,950,054 | A | 9/1999 | Kim |
| 6,011,943 | A | 1/2000 | Kim |
| 6,776,099 | B1 | 8/2004 | Landa et al. |
| 8,509,656 | B2 | 8/2013 | Kopp |
| 2007/0263064 | A1 * | 11/2007 | Anderson |

FOREIGN PATENT DOCUMENTS

| | | |
|---|---|---|
| DE | 102008048256 | 4/2010 |
| DE | 102009060334 | 6/2011 |
| DE | 102010015985 | 9/2011 |

* cited by examiner

*Primary Examiner* — Susan Lee
(74) *Attorney, Agent, or Firm* — Schiff Hardin LLP

(57) ABSTRACT

In a digital printer, print groups are provided each having a respective developer station using liquid developer comprising carrier fluid and toner. A supply arrangement to supply the print groups is provided with fluids and to accept used and unconsumed fluids from the print groups. The supply arrangement has a first supply unit common to all print groups to supply the print groups with the fluids, at least one reservoir containing a carrier fluid. A second supply unit per color supplies the respective print group for the color with liquid developer. The second supply unit comprises a first buffer container connected with a reservoir, the reservoir containing carrier fluid and concentrated toner as toner concentrate. A second buffer container for carrier fluid is connected with the carrier fluid reservoir in the first supply unit. A mixing unit is connected with the first and second buffer containers for mixing together the liquid developer, the mixing unit being connected via a feed pump to supply the liquid developer for the color to the respected developer station of the respective print group.

14 Claims, 3 Drawing Sheets

DIGITAL PRINTER WITH SUPPLY ARRANGEMENT TO SUPPLY PRINT GROUPS WITH FLUIDS AND TO ACCEPT USED AND UNCONSUMED FLUIDS

BACKGROUND

The disclosure concerns a digital printer to print to a recording material with toner particles that are applied with the aid of a liquid developer, in particular a high-speed printer to print to web-shaped or sheet-shaped recording materials.

In such digital printers, a latent charge image is inked with the aid of a liquid developer by means of electrophoresis. The toner image created in such a manner is transferred indirectly via a transfer element or directly to the recording material. The liquid developer has toner particles and carrier fluid in a desired ratio. Mineral oil is advantageously used as a carrier fluid. In order to provide the toner particles with an electrostatic charge, charge control substances are to be added to the liquid developer. Further additives are additionally added in order to achieve the desired viscosity or a desired drying response of the liquid developer, for example.

Such digital printers have already long been known, for example from DE 10 2010 015 985 A1, DE 10 2008 048 256 A3 or DE 10 2009 060 334 A1.

Digital printers for a color printer have at least one print group per color that has as function units at least one electrophotography station to generate charge images of images to be printed and a developer station for inking the charge images with toner. A transfer station can additionally be provided in order to transfer-print the toner images onto the recording material. These function units must be supplied with fluids—for example, the developer station must be supplied with liquid developers that are mixed together from at least carrier fluid and toner. A supply arrangement with which the function units of a printer can be supplied with fluid is known from U.S. Pat. No. 6,776,099 B1.

SUMMARY

It is an object to achieve a digital printer to print to a recording material, which digital printer has a high process stability given minimized loading of the liquid developer due to low mechanical stress, and that has a high print quality due to consistent properties of the liquid developer. The digital printer should be suitable for color printing and can have multiple print groups, and can additionally be usable for simplex or duplex printing. In particular, a supply arrangement should be specified for supplying the digital printer with liquids, via which liquids are supplied to the print groups of the digital printer and used and unconsumed liquids are accepted from the print groups. Such fluids are, for example, the liquid developer and its components.

In a digital printer, print groups are provided each having a respective developer station using liquid developer comprising carrier fluid and toner. A supply arrangement to supply the print groups is provided with fluids and to accept used and unconsumed fluids from the print groups. The supply arrangement has a first supply unit common to all print groups to supply the print groups with the fluids, at least one reservoir containing a carrier fluid. A second supply unit per color supplies the respective print group for the color with liquid developer. The second supply unit comprises a first buffer container connected with a reservoir, the reservoir containing carrier fluid and concentrated toner as toner concentrate. A second buffer container for carrier fluid is connected with the carrier fluid reservoir in the first supply unit. A mixing unit is connected with the first and second buffer containers for mixing together the liquid developer, the mixing unit being connected via a feed pump to supply the liquid developer for the color to the respected developer station of the respective print group.

DESCRIPTION OF EXEMPLARY EMBODIMENTS

Figure 1:
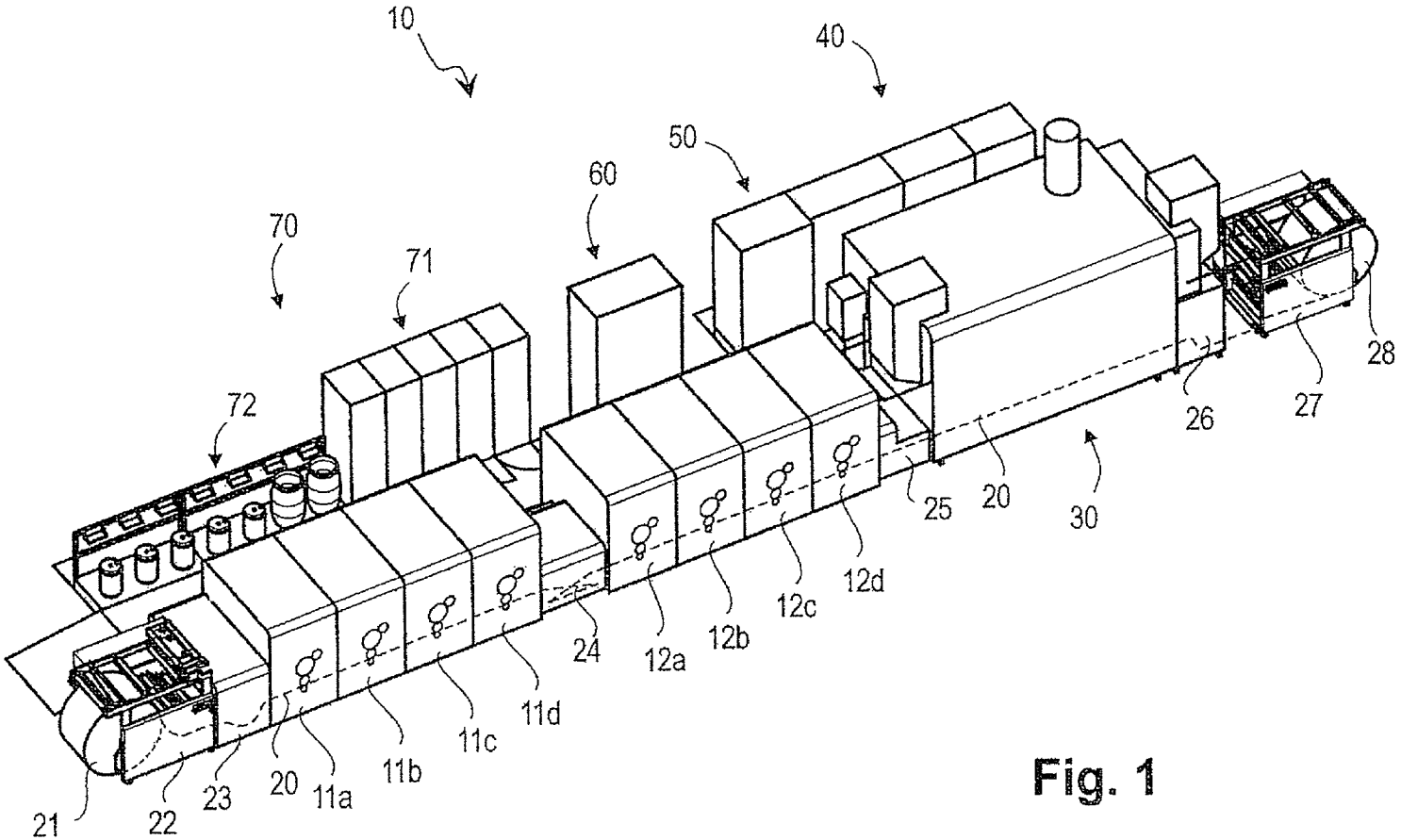
FIG. 1 is a view of a digital printer in an example configuration of the digital printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

The digital printer for color printing or duplex printing to print to a recording material has print groups with a respective electrophotography station to generate charge images of images to be printed on a charge image carrier, and with a respective developer station to ink the charge images on the charge image carrier using liquid developer. A digital printer that is usable in such a manner must be supplied at least with liquid developer of different toner colors, and the components of the liquid developer. For this, it has a supply arrangement to supply the print groups with fluids and to accept used and unconsumed fluids from the print groups. The supply arrangement comprises

- a first supply unit common to all print groups that is provided to supply the print groups with fluids that should be available to all print groups, for example with carrier fluid; and
- a second supply unit per color to be printed to supply the print groups with liquid developer that includes the toner of this color.

The second supply unit comprises

- a first buffer container for a toner concentrate made up of carrier fluid and concentrated toner of the respective color,
- a second buffer container for carrier fluid, and
- a mixing unit connected with the buffer containers for mixing together the liquid developer, wherein the mixing unit is connected (via a common feed pump to supply liquid developer) with the developer stations of the print groups for one color, and is connected with these developer stations via a common discharge pump to accept the liquid developer cleaned off after the development of the charge images in the developer stations.

Exemplary embodiments of the invention are explained in detail in the following using the schematic drawings.

According to FIG. 1, a digital printer 10 to print to a recording material 20 has one or more print groups 11*a*-11*d* and 12*a*-12*d* that print a toner image (print image 20'; see FIG. 2) onto the recording material 20. As shown, a web-shaped recording material 20 as recording material 20 is unrolled from a roll 21 (with the aid of an unroller 22) and supplied to the first print group 11*a*. The print image 20' is fixed on the recording material 20 in a fixing unit 30. The recording material 20 can subsequently be rolled up on a roll 28 with the aid of take-up roller 27. Such a configuration is also designated as a roll-to-roll printer.

In the preferred configuration shown in FIG. 1, the web-shaped recording material 20 is printed in full color with four print groups 11*a* through 11*d* on the front side and with four print groups 12*a* through 12*d* on the back side (what is known as a 4/4 configuration). For this, the recording material 20 is unwound from the roll 21 by the unroller 22 and is supplied via an optional conditioning group 23 to the first print group 11*a*. In the conditioning group 23, the recording material 20 is pre-treated or coated with a suitable substance. Wax or chemically equivalent substances can advantageously be used as a coating substance (also designated as a primer).

This substance can be applied over the entire area, or only to the locations of the recording medium 20 that are to be printed later, in order to prepare the recording medium 20 for the printing and/or to affect the absorption behavior of the recording medium 20 upon the apparatus of the print image 20'. It is therefore prevented that the toner particles or the carrier fluid that are applied later do not penetrate too much into the recording medium 20 but rather remain significantly on the surface (color and image quality is thereby improved).

The recording medium 20 is subsequently initially supplied in order to the first print groups 11*a* through 11*d* in which only the front side is printed. Each print group 11*a*-11*d* typically prints to the recording medium 20 in a different color or also with a different toner material (for example MICR toner, which can be read electromagnetically).

After printing to the front side, the recording medium 20 is turned in a turning unit 24 and is supplied to the remaining print groups 12*a*-12*d* for printing to the back side. Optionally, an additional conditioning group (not shown) can be arranged in the region of the turning unit 24, via which the recording medium 20 is prepared for printing to the back side—for example a fixing (partial fixing) or other conditioning of the previously printed front side print image (or of the entire front side or even back side). It is thus prevented that the front side print image is mechanically damaged in the further transport through the subsequent print groups.

In order to achieve a full color printing, at least four colors (and therefore at least four print groups 11, 12) are required, and in fact the primary colors YMCK (yellow, magenta, cyan and black), for example. Additional print groups 11, 12 with special colors (for example customer-specific colors or additional primary colors in order to expand the printable color space) can also be used.

Arranged after the print group 12*d* is a register unit 25 via which registration marks—that are printed on the recording medium 20 independent of the print image 20' (in particular outside of the print image 20')—are evaluated. The transversal and longitudinal registration (the primary color points that form a color point should be arranged atop one another or spatially very close to one another; this is also designated as color register or four-color register) and the register (front side and back side must spatially coincide precisely) can therefore be adjusted so that a qualitatively good print image 20' is achieved.

Arranged after the register unit 25 is the fixer unit 30 via which the print image 20' is fixed on the recording medium 20. In electrophoretic digital printing, a thermal dryer is advantageously used as a fixer unit 30, which thermal dryer for the most part evaporates the carrier fluid so that only the toner particles remain on the recording medium 20. This occurs under the effect of heat. The toner particles can thereby also be fused to the recording medium 20 insofar as they have a material (resin, for example) that can be melted as a result of thermal action.

Arranged after the fixer unit 30 is a feed group 26 that draws the recording medium 20 through all print groups 11*a*-12*d* and the fixing unit 30 without an additional drive being arranged in this region. The danger that the not-yet fixed print image 20' could be smeared would exist due to a friction drive for the recording medium 20.

The feed group 26 supplies the recording medium 20 to the take-up roller 27 that rolls up the printed recording medium 20.

Centrally arranged in the print groups 11, 12 and the fixer unit 30 are all supply devices for the digital printer 10, such as climate control modules 40, power supply 50, controller 60, fluid management modules 70 (such as fluid control unit 71 and reservoir 72 of the various fluids). Hereby required as fluids are in particular pure carrier fluid, highly concentrated liquid developer (higher proportion of toner particles in relation to the carrier fluid) and serum (liquid developer plus charge control substances) in order to supply the digital printer 10, as well as waste containers for the fluids to be disposed of or containers for cleaning fluid.

The digital printer 10 has a modular design with its structurally identical print groups 11, 12. The print groups 11, 12 do not differ mechanically but rather via the liquid developer (toner color or toner type) that is used therein.

Figure 2:
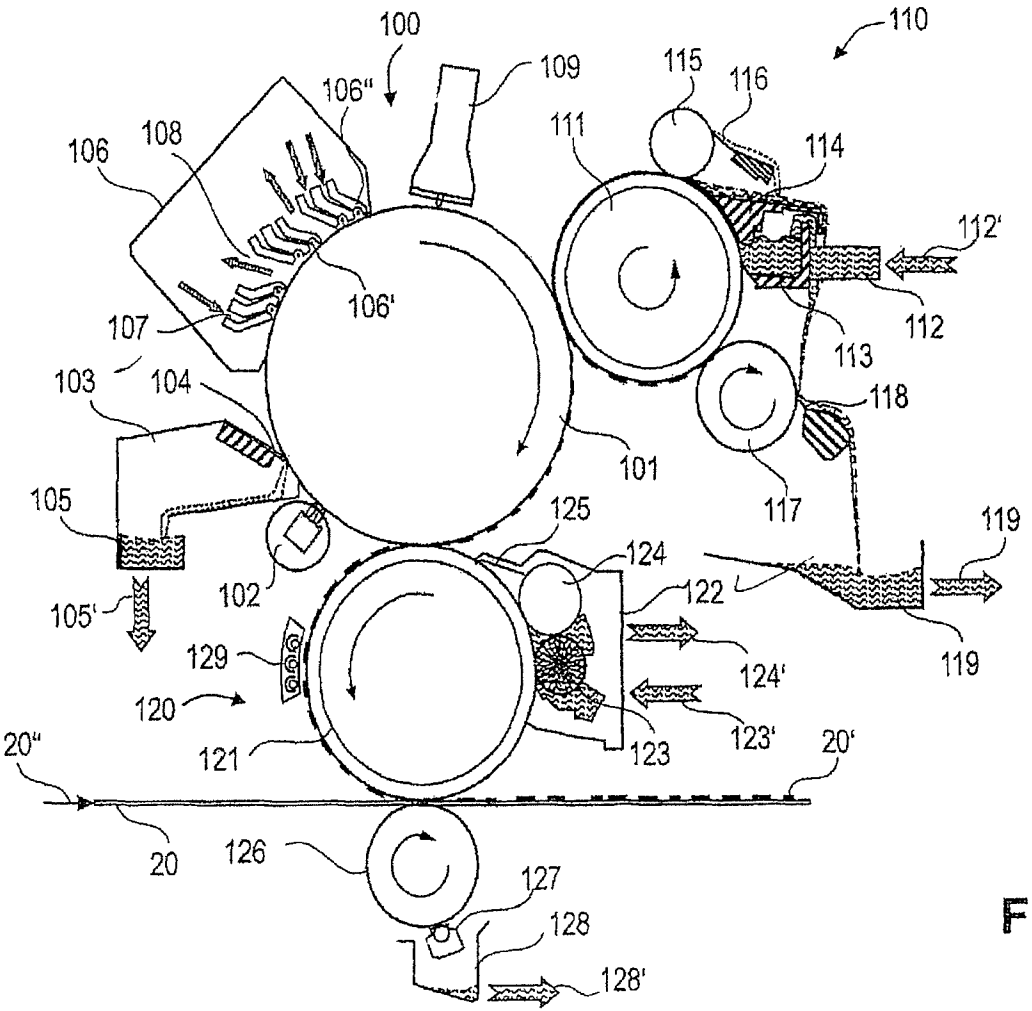
FIG. 2 is a schematic design of a print group of the digital printer according to FIG. 1.

The principle design of a print group 11, 12 is shown in FIG. 2. Such a print group is based on the electrophotographic principle, in which a photoelectric image carrier is inked with charged toner particles with the aid of a liquid developer, and the image that is created in such a way is transferred to the recording medium 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). The photoconductor here is designed as a roller (photoconductor roller 101) and has a hard surface. The photoconductor roller 101 rotates past the various elements to generate a print image 20' (rotation in direction of the arrow).

The photoconductor is initially cleaned of all contaminants. For this, a canceling light 102 is present that cancels charges still remaining on the surface of the photoconductor. The canceling light 102 is adjustable (can be set locally) in order to achieve a homogeneous light distribution. The surface can therefore be pretreated uniformly.

After the canceling light 102, a cleaning device 103 mechanically cleans the photoconductor in order to remove possible dust particles present on the surface of the photoconductor and remaining carrier fluid. The cleaned-off carrier fluid is supplied to a collection container 105. The collected carrier fluid and toner particles are prepared (possibly filtered) and, depending on the color, supplied to a corresponding fluid ink reservoir, i.e. to one of the reservoirs 72 (see arrow 105').

The cleaning device 103 advantageously has a blade 104 that rests on the shell of the photoconductor roller 101 at an acute angle (for instance 10° to 80° relative to the exit surface) in order to mechanically clean the surface. The blade 104 can move back and forth transversal to the rotation direction of the photoconductor roller 101 in order to clean the shell over the entire axial length with as little wear as possible.

The photoconductor is subsequently charged by a charging device 106 to a predetermined electrostatic potential. Multiple corotrons (in particular glass sheath corotrons) are advantageously present for this. The corotrons comprise at least one wire 106' at which a high electric voltage is applied. The air around the wire 106' is ionized by the voltage. A shield 106" is present as a counter-electrode. The corotrons are additionally flushed with fresh air that is supplied via special air channels (ventilation channel 107 for aeration and exhaust channel 108 for venting) between the shields (see also air flow arrows in FIG. 2). The supplied air is then ionized uniformly at the wire 106'. A homogeneous, uniform charging of the adjacent surface of the photoconductor is thereby achieved. The uniform charging is further improved with dry and heated air. Air is exhausted via the exhaust channels 108. Ozone that is possibly created can likewise be drawn off via the exhaust channels 108.

The corotrons can be cascaded, meaning that two or more wires 106' are then present per shield 106" at the same shield voltage. The current that flows over the shield 106" is adjustable, and the charge of the photoconductor can thereby be controlled. The corotrons can be fed with current of different strengths in order to achieve a uniform and sufficiently high charge at the photoconductor.

Arranged after the charging device 106 is a character generator 109 that discharges the photoconductor per pixel depending on the desired print image 20' via optical radiation. A latent image thereby arises that is later inked with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical imaging points on the photoconductor determine the resolution of the print image 20' (typical resolution is 600×600 dpi). The LEDs can be controlled individually in time and with regard to their radiation power. Multilevel methods can thus be applied to generate raster points (comprising multiple image points or pixels), or image points can be delayed in order to implement corrections electro-optically, for example given incorrect color register or register.

The character generator 109 has a control logic that must be cooled due to the plurality of LEDs and their radiation power. The character generator 109 is advantageously liquid-cooled. The LEDs can be controlled in groups (multiple LEDs assembled into one group) or separately from one another.

The latent image generated by the character generator 109 is inked with toner particles by the developer station 110. For this the developer station 110 has a rotating developer roller 111 that directs a layer of liquid developer past the photoconductor (the functionality of the developer station 110 is explained in detail further below). Since the surface of the photoconductor roller 101 is relatively hard, the surface of the developer roller 111 is relatively soft, and when the two are pressed against one another a thin, high nip (a gap between the rollers) is created in which the charged toner particles migrate electrophoretically from the developer roller 111 to the photoconductor at the image points due to an electric field. No toner passes to the photoconductor in the non-image points. The nip filled with liquid developer has a height (thickness of the gap) that is dependent on the mutual pressure of the two rollers 101, 111 and the viscosity of the liquid developer. The thickness of the nip is typically in a range of (for instance) greater than 2 μm to (for instance) 20 μm (the values can also change depending on the viscosity of the liquid developer). The length of the nip amounts to a few millimeters, for instance.

The inked image rotates with the photoconductor roller 101 up to a first transfer point at which the inked image is essentially completely transferred to a transfer roller 121. At the first transfer point (nip between photoconductor roller 101 and transfer roller 121), the transfer roller 121 moves in the same direction and advantageously with the same speed as the photoconductor roller 101. After the transfer of the print image 20' onto the transfer roller 121, the print image 20' (toner particles) can optionally be recharged or charged by means of a charging unit 129 (a corotron, for example) in order to be able to subsequently transfer the toner particles better onto the recording medium 20.

The recording medium 20 runs in the transport direction 20" between the transfer roller 121 and a counter-pressure roller 126. The contact region (nip) represents a second transfer point in which the toner image is transferred onto the recording medium 20. In the second transfer region, the transfer roller 121 moves in the same direction as the recording medium 20. The counter-pressure roller 126 also rotates in this direction in the region of the nip. The speeds of the transfer roller 121, the counter-pressure roller 126 and the recording medium 20 are matched to one another at the transfer point and are advantageously identical so that the print image 20' is not smeared. At the second transfer point, the print image 20' is electrophoretically transferred onto the recording medium 20 due to an electric field between the transfer roller 121 and the counter-pressure roller 126. Moreover, the counter-pressure roller 126 presses with a large mechanical force against the relatively soft transfer roller 121, whereby the toner particles also remain adhered to the recording medium 20 due to the adhesion.

Since the surface of the transfer roller 121 is relatively soft and the surface of the counter-pressure roller 126 is relatively hard, upon rolling a nip is created in which the toner transfer occurs. Unevennesses of the recording medium 20 can therefore be compensated so that the recording medium 20 can be printed to without gaps. Such a nip is also well suited in order to print to thicker or more uneven recording media 20, for example as is the case in printing packaging.

The print image 20' should in fact transfer completely to the recording medium 20; nevertheless, a few toner particles can undesirably remain on the transfer roller 121. A portion of the carrier fluid always remains on the transfer roller 121 as a result of the wetting. The toner particles that are possibly still present should be nearly completely removed via a cleaning unit 122 following the second transfer point. The carrier fluid located on the transfer roller 121 can also be removed completely or up to a predetermined layer thickness from the transfer roller 121 so that, after the cleaning unit 122 and before the first transfer point from the photoconductor roller 101 to the transfer roller 121, the same conditions prevail due to a clean surface or a defined layer thickness with liquid developer on the surface of the transfer roller 121.

This cleaning unit 122 is advantageously designed as a wet chamber with a cleaning brush 123 and a cleaning roller 124. In the region of the brush 123, cleaning fluid (carrier fluid or a separate cleaning fluid can be used, for example) is supplied via a cleaning fluid feed 123'. The cleaning brush 123 rotates in the cleaning fluid and thereby "brushes" the surface of the transfer roller 121. The toner adhering to the surface is thereby loosened.

The cleaning roller 124 lies at an electric potential that is opposite the charge of the toner particles. As a result of this, the electrically charged toner is removed from the transfer roller 121 by the cleaning roller 123. Since the cleaning roller 124 contacts the transfer roller 121, it also takes up carrier fluid remaining on the transfer roller 121 together with the supplied cleaning fluid. A conditioning element 125 is arranged at the discharge from the wet chamber. As shown, a retention plate that is arranged at an obtuse angle (for instance between 100° and 170° between plate and discharge surface) relative to the transfer roller 121 can be used as a conditioning element 125, whereby residues of fluid on the surface of the roller are nearly completely retained in the wet chamber and supplied to the cleaning roller 124 for removal via a cleaning fluid discharge 124' to a cleaning fluid reservoir (shown in FIG. 3).

Instead of the retention plate, a dosing unit (not shown) can also be arranged there that, for example, has one or more dosing rollers. The dosing rollers have a predetermined clearance from the transfer roller 121 and remove so much carrier fluid that a predetermined layer thickness is set after the dosing rollers as a result of the squeezing. The surface of the transfer roller 121 is then not completely cleaned off; and carrier fluid of a predetermined layer thickness remains over the entire surface. Removed carrier fluid is directed back to the carrier fluid reservoir via the cleaning roller 124.

The cleaning roller 124 itself is kept clean mechanically via a blade (not shown). Cleaned-off fluid including toner particles for all colors are captured via a central collection container, cleaned and supplied to the central cleaning fluid container for re-use.

The counter-pressure roller 126 is likewise cleaned by a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and (possibly cleaned via a fluid discharge 128') provided again to the printing process.

In the print groups 11 that print to the front side of the recording medium 20, the counter-pressure roller 126 presses against the unprinted side (and thus undried side) of the recording medium 20.

Nevertheless, dust/paper particles or other soil particles can already be located on the dry side, which are then removed from the counter-pressure roller 126. For this, the counter-pressure roller 126 should be wider than the recording medium 20. As a result of this, contaminants outside of the printing region can also be cleaned off well.

In the print groups 12 that print to the back side of the recording medium 20, the counter-pressure roller 126 presses directly on the not yet fixed, damp print image 20' of the front side. So that the print image 20' is not removed by the counter-pressure roller 126, the surface of the counter-pressure roller 126 must have anti-adhesion properties with regard to toner particles, and also with regard to the carrier fluid on the recording medium 20.

The developer station 110 inks the latent print image 20' with a predetermined toner. For this, the developer roller 111 directs toner particles onto the photoconductor. In order to ink the developer roller 111 itself with a layer over its entire surface, liquid developer is initially supplied with a predetermined concentration from a mixing unit 314 (shown in FIG. 3) via a fluid feed 112' to a storage chamber 112. From this storage chamber 112, the liquid developer is abundantly supplied to a pre-chamber 113 (a type of trough, open at the top). Towards the developer roller 111, an electrode segment 114 is arranged that forms a gap between itself and the developer roller 111.

The developer roller 111 rotates through the upwardly open pre-chamber 113 and thereby takes liquid developer along into the gap. Excess liquid developer runs from the pre-chamber 113 back to the storage chamber 112.

Due to the electrical field formed by the electrical potentials between the electrode segment 114 and the developer roller 111, the liquid developer is divided in the gap into two regions, and in fact into a layer region in proximity to the developer roller 111 in which the toner particles are concentrated (concentrated liquid developer) and a second region in proximity to the electrode segment 114 that is low in toner particles (very low-concentration liquid developer).

The layer of liquid developer is subsequently transported further to a dosing roller 115. The dosing roller 115 squeezes out the upper layer of the liquid developer so that a defined layer thickness of liquid developer of approximately 5 μm thickness subsequently remains on the developer roller 111. Since the toner particles are essentially located near the surface of the developer roller 111 in the carrier fluid, the outlying carrier fluid is essentially squeezed out or held back and is ultimately directed back to a collection container 119, but not supplied to the storage chamber 112.

As a result of this, predominantly highly concentrated liquid developer is conveyed through the nip between dosing roller 115 and developer roller 111. A uniformly thick layer of liquid developer thus arises with approximately 40 percent by mass toner particles and approximately 60 percent by mass carrier fluid after the dosing roller 115 (the mass ratios can also fluctuate more or less depending on the printing process requirements). This uniform layer of liquid developer is transported in a nip between the developer roller 111 and the photoconductor roller 101. There the image points of the latent image are then electrophoretically inked with toner particles, while no toner passes to the photoconductor in the region of non-image points. Sufficient carrier fluid for electrophoresis is absolutely necessary. The fluid film divides approximately in the middle after the nip as a result of wetting, such that one portion of the layer remains adhered to the surface of the photoconductor roller 101 and the other portion (essentially carrier fluid for image points and toner particles and carrier fluid for non-image points) remains on the developer roller 111.

So that the developer roller 111 can again be coated with liquid developer under the same conditions and uniformly, remaining toner particles (these essentially represent the negative, untransferred print image) and liquid developer are removed electrostatically and mechanically by a cleaning roller 117. The cleaning roller 117 itself is cleaned by a blade 118. The cleaned-off liquid developer is supplied to the collection container 119 for re-use, to which is also supplied liquid developer cleaned off from the dosing roller 115 by means of a blade 116 and liquid developer cleaned off of the photoconductor roller 101 by means of the blade 104.

The liquid developer collected in the collection container 119 is supplied to the mixing container via the fluid discharge 119'. Fresh liquid developer and pure carrier fluid are also supplied as needed to the mixing container. Sufficient fluid in the desired concentration (predetermined ratio of toner particles to carrier fluid) must always be present in the mixing container. The concentration in the mixing container is continuously measured and regulated accordingly depending on the feed of the amount of cleaned-off liquid developer and its concentration, as well as on the amount and concentration of fresh liquid developer or carrier fluid.

For this, highly concentrated liquid developer (toner concentrate), pure carrier fluid, serum (carrier fluid and charge control substances in order to control the charge of the toner particles) and cleaned-off liquid developer can be separately supplied from the corresponding storage containers 72 to this mixing container.

Figure 3:
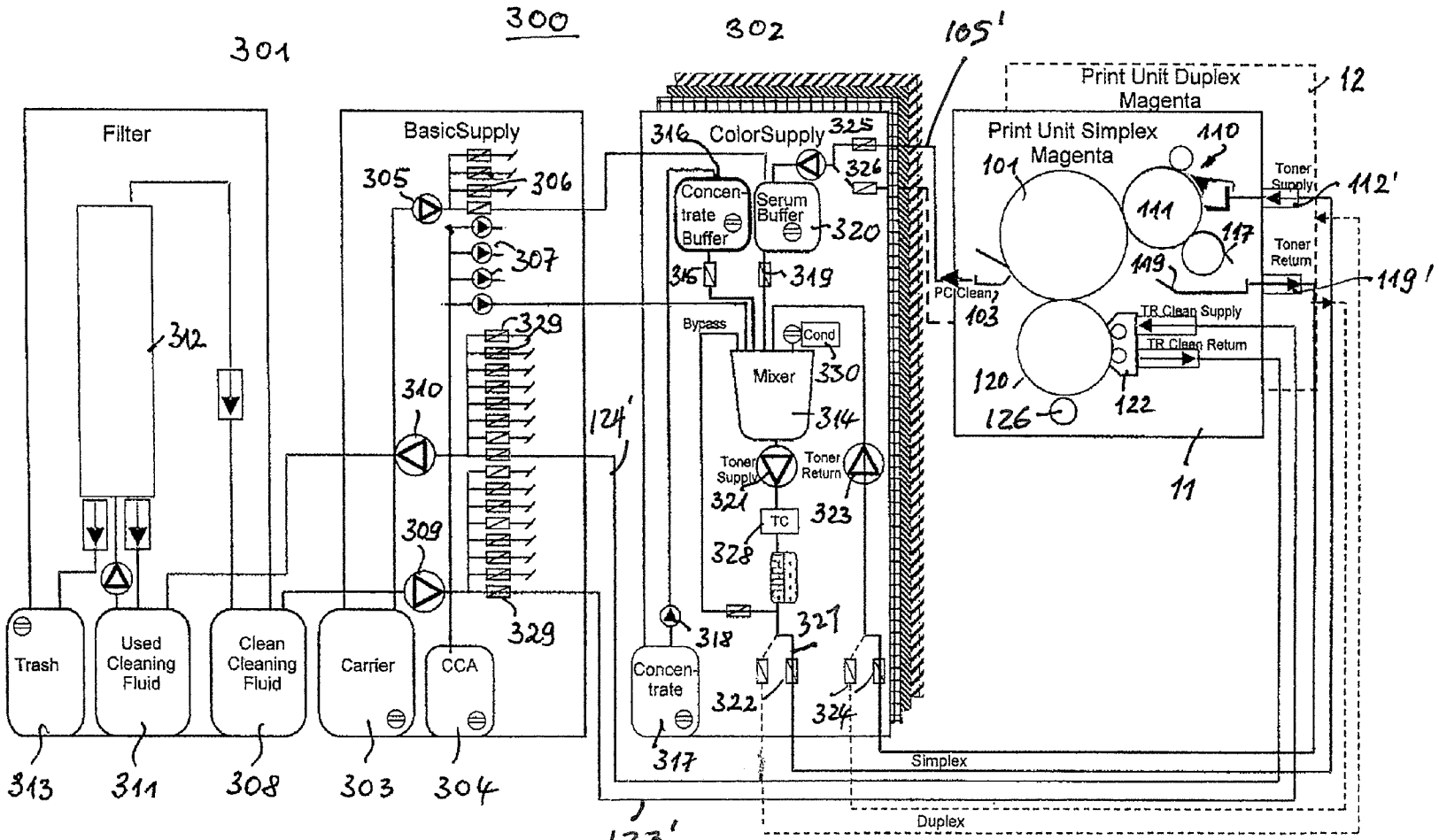
FIG. 3 is a view of an arrangement to supply the print groups with fluids, for example liquid developer and its components.

A supply arrangement 300 to supply at least two print groups 11, 12 with fluids results from FIG. 3 as an arrangement 70 for implementation of the fluid management for the digital printer 10. The print group 11 is thereby drawn in an extracted representation; the print group 12 is drawn with a dashed-line representation. Furthermore, two supply units for print groups (not shown) are indicated behind the second supply unit 302.

The object of the supply arrangement 300 is the supply of fluids to the print groups 11, 12 of the digital printer 10 and the acceptance of used and unconsumed fluids from the print groups 11, 12. Among these fluids are:

- liquid developer that is to be supplied to the developer stations 110 of the print groups 11, 12;
- liquid developer cleaned off at the print groups 11, 12 that should be discharged;
- components of the liquid developer, for example carrier fluid, toner concentrate (carrier fluid with high toner concentration), charge control substances;
- possible cleaning fluids that must be used to clean rollers and that must be discharged again after the cleaning.

In order to save on costs, the fluids accepted by the supply arrangement 300 can optimally be prepared again in order to be able to reuse them.

According to FIG. 1 and FIG. 2, the supply arrangement 300 should therefore supply fluids to the following function units of the print groups 11, 12 or accept fluids from the function units:

- liquid developer should be supplied to the electrode segment 114 of the developer station 110 via the supply line 112';
- excess liquid developer (thus liquid developer that is not consumed for the development of the charge images on the photoconductor roller 101) in the developer station 110 that has been collected in the collection container 119 should be discharged via the supply line 119';
- a cleaning fluid should be supplied via the supply line 123' to the cleaning unit 122 of the transfer station 120;
- used cleaning fluid should be discharged from the cleaning unit 122 via the supply line 124';
- remaining fluid removed from the recording material 20 by the counter-pressure roller 126, which remaining fluid has been collected in the container 128, should be discharged via the supply line 124'; and
- fluid removed from the photoconductor roller 101 by the cleaning device 103, which fluid has been collected in the container 105, should be discharged via the supply line 105'.

Liquid developer must additionally be supplied to the print groups 11, 12 in their print colors; the liquid developer has at least carrier fluid and toner, but charge control substances can additionally be admixed.

A supply arrangement 300 should thus be designed such that it can supply the print groups 11, 12 with the fluids illustrated above. A corresponding supply arrangement 300 is presented in FIG. 3, which here can supply two print groups 11, 12 with liquid developer of the same color (thus can be used for simplex or duplex printing.

The supply arrangement 300 has two supply units 301, 302. The first supply unit 301 is only provided once and takes on the supply of the print groups 11, 12 with fluids that are usable by all print groups; in contrast to this, the second supply unit 302 is provided once per color to be printed.

The supply arrangement 300 according to FIG. 3 thus has the first supply unit 301 (basic supply) that is used jointly for the print groups 11, 12 and additional print groups (only indicated in FIG. 3), while a second supply unit 302 (color supply) is respectively associated with the print groups that print with the same color.

The first supply unit 301 initially comprises a storage container 303 for carrier fluid and a storage container 304 for a charge control substance (if such a thing is provided in the liquid developer). The storage container 303 for carrier fluid is connected via a common pump 305 and a respective valve 306 per second supply unit 302 with the second supply units 302 such that carrier fluid can be supplied to said second supply units 302. The transport of carrier fluid can be interrupted or second supply units 302 for additional print groups 11, 12 can be connected with the aid of the valves 306. If a charge control substance should be used in the liquid developer, the corresponding storage container 304 can respectively be connected with the second supply units 302 via a pump 307.

Furthermore, the first supply unit 301 can provide a reservoir 308 for a cleaning fluid if a cleaning fluid (for example for cleaning a transfer roller 121 or a counter-pressure roller 126) is used in the transfer station 120 of the print groups 11, 12. The reservoir 308 or the coding gradient can be directly connected with the transfer station 120 via a pump 309. Cleaning fluid used in the cleaning can be directed back again to the first supply unit 301, and in fact via a pump 310 into a container 311 for used cleaning fluid. The used cleaning fluid can then be cleaned with the aid of a filter 312, wherein cleaned cleaning fluid can be supplied again to the container 308. Waste products filtered out in the filtering can be collected in a container 313.

The second supply unit 302 has a mixing unit 314 in which the liquid developer for the print groups 11, 12 is mixed. The mixing unit 314 is connected via a valve 315 with a buffer container 316; and toner concentrate can be supplied from a container 317 for toner concentrate to the buffer container 316 with the aid of a pump 318. The mixing unit 314 is furthermore connected with the buffer container 320 for carrier fluid via a valve 319. This buffer container 320 is connected via the valve 306 with the reservoir 303 for carrier fluid of the first supply unit 301, such that new carrier fluid can be supplied to this buffer container 320. Finally, charge control substance can be directly supplied as needed to the mixing unit 314 from the container 304 of the first supply unit 301 via a pump 307.

To supply the developer station 110 of the print groups 11, 12 with liquid developer, the mixing unit 314 is connected with the developer stations 110 via a common pump 321 and a respective valve 322 with the input 112'. The outlet 119' for cleaned-off liquid developer of the developer stations 110 is connected with the mixing unit 314 via a common pump 323 and a respective valve 324. The cleaned-off liquid developer can therefore be supplied again from the developer station 110 to the mixing unit 314.

If the second supply unit 302 should be used to supply a second print group 12 (as indicated by the dashed lines in FIG. 3), the connection of the mixing unit 314 to the second print group 12 can be established via valves 322, 324 and the common pumps 321, for example in order to enable a duplex operation.

Finally, the cleaning device 103 for cleaning the photoconductor drum 101 (and in fact the collection container 105) are connected via a valve 325 and a pump 326 to the buffer container 320 for the carrier fluid. This also applies to the second print group 12, which can be connected to the buffer container 320 via a valve 325 and the pump 326.

The first supply unit 301 thus provides functions that are usable by all print groups 11, 12; in contrast to this, the second supply unit 302 provides functions per color.

The first supply unit 301 is thus appropriate for collective functions for print groups 11, 12, for example supplying the developer stations 110 with carrier fluid or supplying the transfer stations 120 with cleaning fluid.

The second supply unit 302 has the task of supplying the print groups 11, 12 with liquid developer; a second supply unit 302 is respectively provided per color. Print groups that use liquid developer of the same color (as this is shown for print groups 11, 12 in FIG. 3) can therefore interact with the same second supply unit 302.

The second supply unit 302 thereby has the following function features in the supply of two print groups 11, 12, for example in duplex operation:

a) the second supply unit 302 and the print groups 11, 12 form an EWS circuit:

There is a common circuit of the mixing unit 314 with the developer stations 110 for simplex operation and duplex operation.

Only one feed pump 321 is arranged in the connection of the mixing unit 314 with the developer stations 110 of the print groups 11, 12; the switching to or switching away from a print group 11, 12 takes place via valves 322.

The collection container 119 for cleaned-off liquid developer in the developer stations 110 is connected with the mixing unit 314 only via a discharge pump 323. The switching to or switching away from a print group 11, 12 takes place via valves 324.

only one sensor 321 is provided to measure the toner concentration TC. Depending on the measurement result, by switching the valves 315, 319 the fluid control unit 71 (FIG. 1) can conduct toner concentrate from the buffer container 316 or carrier fluid from the buffer container 320 into the mixing unit 314.

Sensors are provided to determine the fill level of the collection container 119 of the print groups 11, 12 and the mixing unit 314. An overflow in the collection containers 119 or the mixing unit 314 or, respectively, a complete emptying of the collection container 119 or the mixing unit 314 can therefore be prevented.

b) A mixing unit 314 is provided to mix together the liquid developer for the associated developer stations 110:

Toner concentrate is supplied from the buffer container 316 to the mixing unit 314 via the valve 315. The buffer container 316 is furthermore connected via a pump 318 with the reservoir 317 for the toner concentrate; new toner concentrate can be pumped as needed into the buffer container 316 and be conducted from there into the mixing unit 314.

Carrier fluid is supplied from the buffer container 320 to the mixing unit 314 via the valve 319. The carrier fluid in the buffer container 320 is supplemented via the pump 305 from the reservoir 303 [sic] for carrier fluid of the first supply unit 303.

c) The buffer container 316 is provided for the toner concentrate:

The reservoir 317 for the toner concentrate can therefore be swapped out without the print operation needing to be interrupted, since toner concentrate can be supplied as needed from the buffer container 316 to the mixing unit 314.

The exchange of the reservoir 317 or the filling of the buffer container 316 can be controlled via sensors in the reservoir 317 for the toner concentrate or in the buffer container 316.

The embodiment of the supply arrangement 300 with the two supply units 301, 302 enables a simplex or duplex print operation with the following advantageous properties:

a) a common EWS circuit for simplex and duplex printing is provided:

Via the common circuit it is ensured that the toner properties (in particular the toner concentration) of the liquid developer are the same in the simplex supply path and the duplex supply path. It is therefore ensured that the inking of the charge images on the photoconductors 101 (and therefore the print quality in both print groups 11, 12) is the same.

A common feed pump 321 and discharge pump 323 ensure a stable flow rate for liquid developer in simplex and duplex operation.

The feed pump 321 can be operated in an unregulated manner if excess output is dealt with in the developer station 110, thus if more liquid developer is supplied than is used in the inking of the charge images.

The switching to a print group 11, 12 takes place via valves 322, 324. If printing should take place only in a simplex operation, a bypass line 327 can be switched to so that the conveyed quantity of liquid developer remains constant per print group 11 or 12.

Air suction can be avoided with the aid of the switching of the valves 324 depending on the fill level of the collection container 324 in the developer station 110.

The common transport circuit for the liquid developer enables a higher average areal coverage since simplex and duplex operation mutually balance.

If printing takes place with maximum areal coverage, it is not carrier fluid but rather only toner concentrate that is supplied to the mixing unit 314. Printing can therefore take place stably with 100% areal coverage without user intervention.

b) Toner concentrate transport

The use of a buffer container 316 in combination with a respective fill level sensor in said buffer container 316 and in the reservoir 317 for the toner concentrate enables a routine that starts if said reservoir 317 is not yet empty and there is still sufficient time in order to change the reservoir 317. Printing can therefore take place without interruption.

c) Cleaning the photoconductor 101

Since only carrier fluid with a small quantity of residual toner accumulates in the cleaning of the photoconductor roller 101, the cleaning device 103 can be connected with the buffer container 320 and the carrier fluid can therefore be reused, the more so as new carrier fluid is supplied to the buffer container 320 from the first supply unit 301.

Since the buffer container 320 is connected with the cleaning devices 103 of the two print groups 11, 12 in duplex operation, the cleaned-off carrier fluid is supplied from the two cleaning devices 103 to the buffer container 320.

d) Mixing unit 314

The toner properties of the liquid developer in the mixing unit 314 can also be regulated with regard to the electric conductivity. For this, the electric conductivity of the liquid developer is measured by a sensor 328, and as necessary a charge control substance is conveyed from the first supply unit 301 from the container 320 into the mixing unit 314 via a pump 307.

If the volume of the mixing unit 314 is chosen to be large enough in comparison to the supply lines and the developer station 110, for maintenance purposes said developer station 110 can be completely emptied.

The infeed of the liquid developer from the discharge pump 323 or the bypass 327 into the mixing unit 314 can take place via an infeed plate that is arranged such that the liquid developer flows calmly into the mixing unit 314, and therefore no air bubbles are created that can later lead to print disruptions in the print operation.

e) Modular design of the supply units 301, 302

The design of the supply units 301, 302 and their distribution corresponding to the invention allows a scalable design of the supply arrangement 300. An expansion via additional print groups 11, 12 is additionally easily possible (indicated by the open supply lines in the first supply unit 301).

the first supply unit 301 enables the supply of the second supply units 302 with carrier fluid via a central pump 305 and valves 306, corresponding to the number of colors.

Only a central pump 309 for the supply of the cleaning fluid to the cleaning units 122 of the transfer stations 120 and a central pump 310 and valve 329 for the removal of the cleaning fluid from the transfer stations 120 to the filter unit 312 are required in the cleaning of the transfer stations 120 of the print groups 11, 12.

A design of the supply arrangement 300 separate from the print groups 11, 12 is possible, such that the supply arrangement 300 can be set up corresponding to the spatial conditions.

The photoconductor can preferably be designed in the form of a roller or a continuous belt. An amorphous silicon as a photoconductor or an organic photoconductor material (also designated as an OPC) can thereby be used.

Instead of a photoconductor, other image carriers (such as magnetic, ionizable etc. image carriers) can also be used that do not operate according to the photoelectric principle, but rather on which latent images are impressed electrically, magnetically or otherwise according to other principles, which latent images are then inked and ultimately are transferred onto the recording medium 20.

LED lines or even lasers with corresponding scan mechanism can be used as a character generator 109.

The transfer element can likewise be designed as a roller or as a continuous belt. The transfer element can also be omitted. The print image 20' is then transferred directly from the photoconductor roller 101 onto the recording medium 20.

What is to be understood by the term "electrophoresis" is the migration of charged toner particles in the carrier fluid as a result of the action of an electrical field. In each transfer of toner particles, the corresponding toner particles transfer essentially completely to another element. After contact of the two elements, the fluid film is split approximately in half as the result of the wetting of the participating elements so that approximately one half remains adhered to the first element and the remaining part remains adhered to the other element. The print image 20' is transferred, and in the next part it is then transported further in order to allow an electrophoretic migration of the toner particles again in the next transfer region.

The digital printer 10 can have one or more print groups for the front-side printing and possibly one or more print groups for the back-side printing. The print groups can be arranged in a line, an L-shape or a U-shape.

Instead of the take-up roller 27, post-processing devices (not shown)—such as cutters, folders, stackers etc.—can also be arranged after the feed group 26 in order to bring the recording medium 20 into the final form. For example, the recording medium 20 could be processed so much that a finished book is created at the end. The post-processing devices can likewise be arranged in a row or offset from this.

As has previously been described as a preferred embodiment, the digital printer 10 can be operated as a roll-to-roll printer. It is also possible to cut the recording medium 20 at the end into sheets and to stack the sheets or process them further in a suitable manner (roll-to-sheet printer). It is likewise possible to supply a sheet-shaped recording medium 20 to the digital printer 10 and to stack or further process the sheets at the end (sheet-to-sheet printer).

If only the front side of the recording medium 20 is printed, at least one print group 11 with a color is required (simplex printing). If the back side is also printed, at least one print group 12 for the back side is furthermore required (duplex printing). Depending on the desired print image 20' on the front side and back side, the printer configuration includes a corresponding number of print groups for front side and back side, wherein each print group 11, 12 is always designed for only one color or one type of toner.

The maximum number of print groups 11, 12 is technically dependent on the maximum mechanical tensile load of the recording medium 20 and the free train length. Arbitrary configurations from a 1/0 configuration (only one print group for the front side to be printed) to a 6/6 configuration (in which six print groups are respectively present for front side and back side of the recording medium 20) can typically be present. The preferred embodiment (configuration) is shown in FIG. 1 (a 4/4 configuration) with which the full color printing for front side and back side is provided with four primary colors. The order of the print groups 11, 12 in a four color printing advantageously goes from a print group 11, 12 that prints light (yellow) to a print group 11, 12 that prints dark; for example, the recording medium 20 is thus printed to from light to dark in the color order Y-C-M-K.

The recording medium 20 can be produced from paper, metal, plastic or other suitable and printable materials.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A digital printer for printing to a recording material, comprising:

print groups each having a respective electrophotography station to generate charge images of images to be printed on a charge image carrier and a developer station to ink the charge images on said charge image using liquid developer comprising carrier fluid and toner; and a supply arrangement to supply the print groups with fluids and to accept used and unconsumed fluids from the print groups, said supply arrangement having a first supply unit common to all print groups to supply the print groups with said fluids usable for all print groups, and at least one reservoir containing a carrier fluid, and a second supply unit per color to supply the respective print group for said color with liquid developer of said color, the second supply unit comprising a first buffer container connected with a reservoir, said reservoir containing concentrated toner as toner concentrate, a second buffer container for carrier fluid connected with the carrier fluid reservoir in the first supply unit, and a mixing unit connected with the first and second buffer containers for mixing together the liquid developer, the mixing unit being connected to supply the liquid developer for said color to the respective developer station of the respective print group.

2. A digital printer for printing to a recording material, comprising:

print groups each having a respective electrophotography station to generate charge images of images to be printed on a charge image carrier and a developer station to ink the charge images on said charge image using liquid developer comprising carrier fluid and toner; and a supply arrangement to supply the print groups with fluids and to accept used and unconsumed fluids from the print groups, said supply arrangement having a first supply unit common to all print groups to supply the print groups with said fluids usable for all print groups, and at least one reservoir containing a carrier fluid, and a second supply unit per color to supply the respective print group for said color with liquid developer of said color, the second supply unit comprising a first buffer container connected with a reservoir, said reservoir containing carrier fluid and concentrated toner as toner concentrate, a second buffer container for carrier fluid connected with the carrier fluid reservoir in the first supply unit, and a mixing unit connected with the first and second buffer containers for mixing together the liquid developer, the mixing unit being connected via a feed pump to supply the liquid developer for said color to the respective developer station of the respective print group.

3. The digital printer according to claim 2 wherein the mixing unit is connected with the respective developer station of the respective print group via a discharge pump in order to accept liquid developer cleaned off after development of the charge images in the respective developer station.

4. The new digital printer according to claim 3 wherein the second unit is common to two respective developer stations of respective printing groups for duplex operation, and the feed pump and the discharge pump are common to the two respective developer stations.

5. The digital printer according to claim 2 wherein a common pump and a respective switching element for each second supply unit are arranged between the reservoir for the carrier fluid and the respective second buffer container of the second supply units.

6. The digital printer according to claim 2 wherein the mixing unit is connected via a respective pump with a common reservoir for a charge control substance, said common reservoir being arranged in the first supply unit.

7. The digital printer according to claim 2 wherein the mixing unit of the respective second supply unit is connected via the feed pump and switching elements with the respective developer stations of the respective print groups so that one print group in simplex operation or two print groups in duplex operation can selectively be supplied with liquid developer of the associated color.

8. The digital printer according to claim 7 wherein a bypass line is provided arranged between the output of the supply pump and the mixing unit and that is switched to in simplex operation.

9. The digital printer according to claim 7 wherein valves are provided as said switching elements.

10. The digital printer according to claim 9 wherein a fluid control unit is provided that controls the switching elements and the feed pump.

11. The digital printer according to claim 2 wherein the print group provides a respective cleaning device for the charge image carrier in order to clean remaining liquid developer off of the charge image carrier, and the cleaning devices of the print groups for the same color being respectively connected via a switching element and a common pump with the second buffer container.

12. The digital printer according to claim 2 wherein a respective fill level sensor is arranged in the first buffer container and the reservoir such that the carrier fluid reservoir is swapped out depending on its fill level.

13. The digital printer according to claim 2 wherein the print groups have transfer stations with transfer elements to transfer the charge images developed with toner onto the recording material, respective cleaning units for the transfer elements being provided in the transfer stations to clean the transfer stations of residual liquid developer using a cleaning fluid, a reservoir for the cleaning fluid being provided in the first supply unit, and said cleaning fluid reservoir being connected via a pump with the cleaning units of the transfer stations of the print groups to supply cleaning fluid to the cleaning units; and said cleaning units being connected via a pump with a container arranged in the first supply unit for used cleaning fluid to accept used cleaning fluids from the print groups.

14. The digital printer according to claim 13 wherein a filter unit is arranged in the first supply unit, via said filter unit the used cleaning fluid being directed from the container for cleaning, and the filtered cleaning fluid being supplied again to the container for the cleaning fluid.

* * * * *